US006923659B2

(12) United States Patent
Zhang et al.

(10) Patent No.: US 6,923,659 B2
(45) Date of Patent: Aug. 2, 2005

(54) ELECTRICAL CONNECTOR WITH IMPROVED TERMINALS

(75) Inventors: Chi Zhang, Kunsan (CN); Ming Chuan Wu, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/914,879

(22) Filed: Aug. 9, 2004

(65) Prior Publication Data

US 2005/0032434 A1 Feb. 10, 2005

(30) Foreign Application Priority Data

Aug. 8, 2003 (TW) ..... 92214452

(51) Int. Cl.[7] ..... H01R 12/00
(52) U.S. Cl. ..... 439/74
(58) Field of Search ..... 439/74, 660, 83, 439/607

(56) References Cited

U.S. PATENT DOCUMENTS

| | | | | | |
|---|---|---|---|---|---|
| 5,116,247 | A | | 5/1992 | Enomoto et al. | |
| 5,885,092 | A | * | 3/1999 | Ito et al. | 439/74 |
| 5,931,689 | A | * | 8/1999 | Patel | 439/74 |
| 6,135,785 | A | * | 10/2000 | Niitsu | 439/74 |
| 6,338,630 | B1 | * | 1/2002 | Dong | 439/74 |
| 6,464,515 | B1 | * | 10/2002 | Wu | 439/74 |
| 2001/0027036 | A1 | * | 10/2001 | Goto | 439/74 |

* cited by examiner

*Primary Examiner*—Tho D. Ta
(74) *Attorney, Agent, or Firm*—Wei Te Chung

(57) ABSTRACT

An electrical connector (100) for fixing to a printed circuit board includes an insulative housing (10) and a number of terminals (30) received in the housing. The housing includes a tongue (12) defining a number of first passageways (122). Each of the terminals includes a retention portion (31), a contact portion (32), and a tail (34). The retention portion is received in the first passageway. The contact portion is attached to a surface of the tongue. The tail horizontally extends beyond the housing. The terminals engage with the housing securely.

7 Claims, 5 Drawing Sheets

ELECTRICAL CONNECTOR WITH IMPROVED TERMINALS

BACKGROUND OF THE INVENTION

1. Field of the Invention

The present invention relates to an electrical connector, and particularly to an electrical connector having terminals reliably secured to an insulative housing thereof.

2. Description of Related Art

Electrical connectors are usually used for transmitting information between two printed circuit boards. U.S. Pat. Nos. 5,116,247 and 6,338,630 disclose such connectors. Connectors disclosed by the two patents each comprise an insulative housing and a plurality of terminals received in the housing. The housing comprises a pair of sidewalls and a tongue located therebetween. Each of the sidewalls defines a plurality of passageways. Each of the terminals comprises a contact portion, a retention portion, and a tail. The retention portion is received in the passageway, the contact portion is attached to a surface of the tongue, and the tail extends beyond the housing. The retention portion of each terminal comprises barbs engaging with the corresponding passageway.

Some connectors are used in notebook computer. With the development of the notebook computer, the notebook computer is required to be more thinner and more lighter. For matching the requirement, the connector has to be minimized. As is described above, the sidewall of the connector defines passageways for engaging with the retention portion of the terminals, and in order to keep the terminals securely in the housing, the thickness of the sidewalls cannot decrease without limitation. When the thickness of the sidewall decrease beyond a certain extent, the barbs of the retention portion will pierce the sidewall and destroy the structure of the housing.

Hence, an improved electrical connector is required to overcome the disadvantages of the prior art.

SUMMARY OF THE INVENTION

A major object of the present invention is to provide an electrical connector having improved terminals which is retained in the housing securely.

In order to achieve the object set forth, an electrical connector includes an elongated insulative housing and a plurality of terminals received in the insulative housing. The housing includes a tongue defining a plurality of passageways. Each of the terminals includes a contact portion, a retention portion, and a tail. The retention portion of the terminal is received in the passageway, the contact portion attaches to a surface of the tongue, and the tail extends beyond the housing.

Other objects, advantages and novel features of the invention will become more apparent from the following detailed description when taken in conjunction with the accompanying drawings.

DETAILED DESCRIPTION OF THE INVENTION

Figure 1:
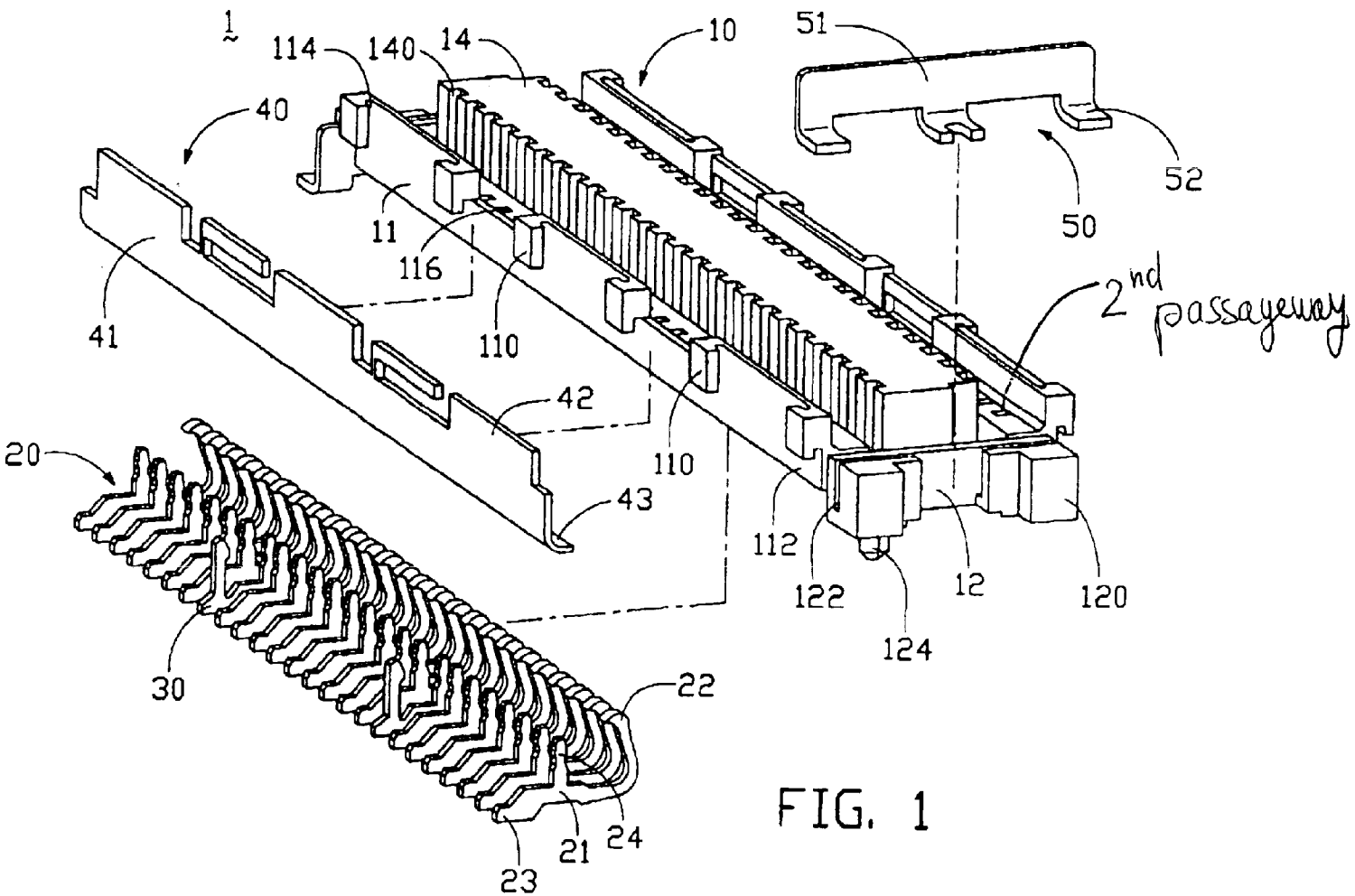
FIG. 1 is an assembled, perspective view of an electrical connector in accordance with the present invention.

Please refer to FIG. 1, an electrical connector 100 in accordance with the present invention comprises an elongated insulative housing 10, a plurality of contacts 30 received in the housing, and a pair of shields 20 assembled on the housing 10.

Figure 2:
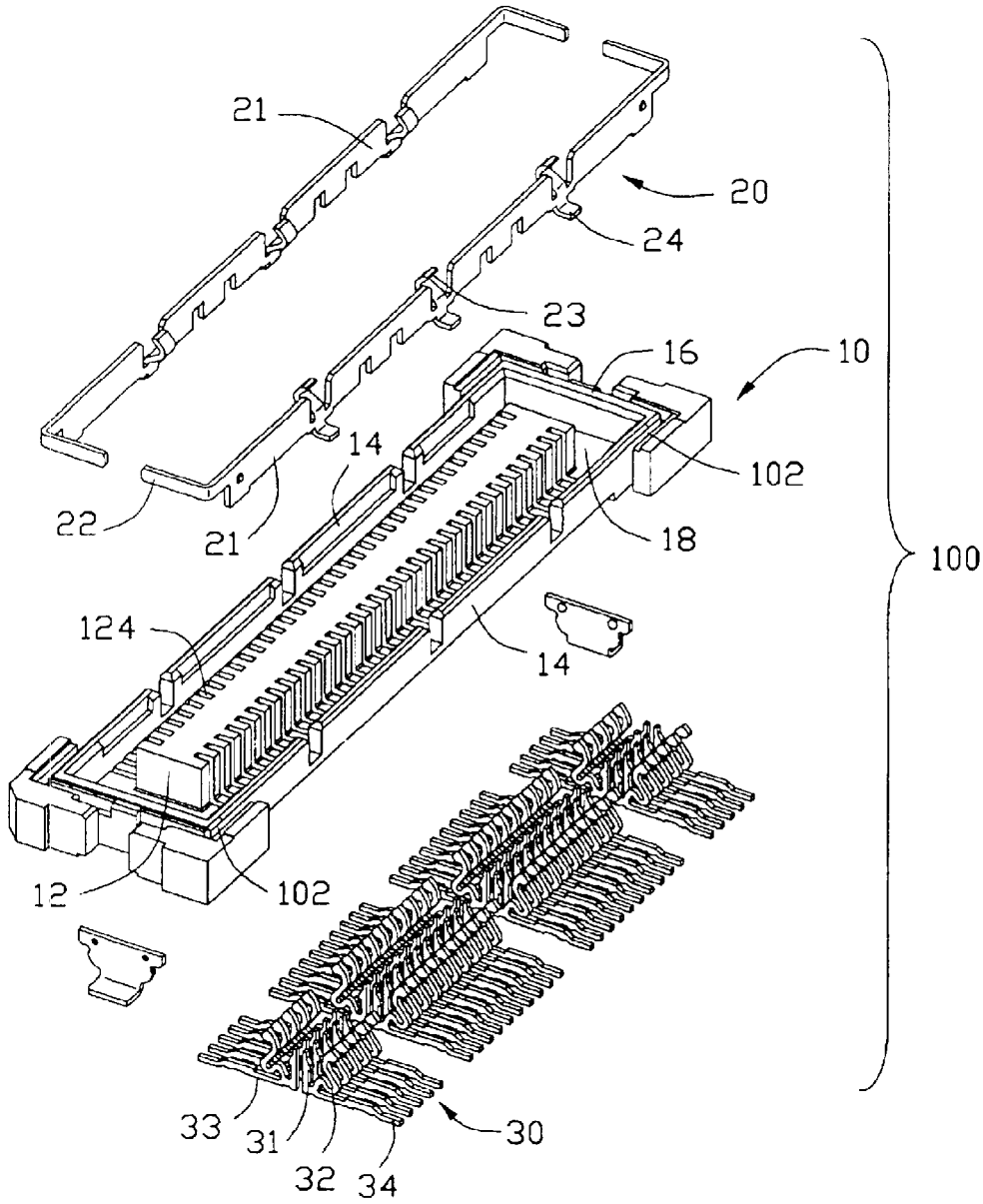
FIG. 2 is an exploded, perspective view of the electrical connector of FIG. 1.
Figure 3:
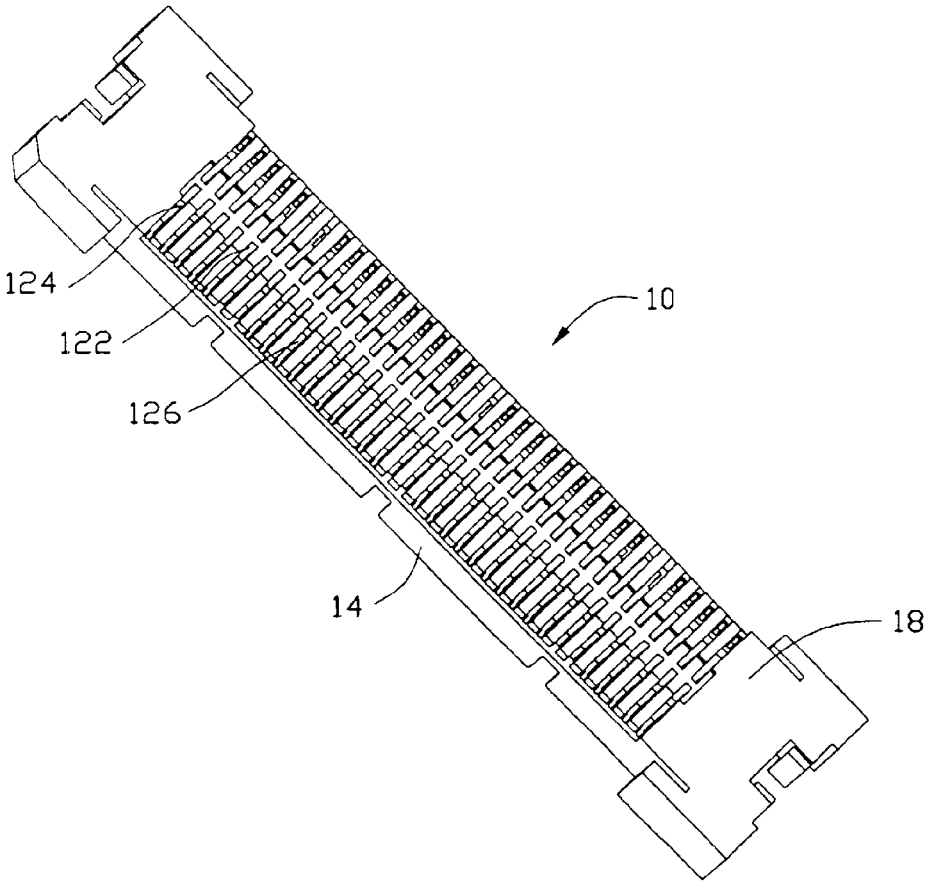
FIG. 3 is a perspective view of a housing of the electrical connector in accordance with the present invention.

Please refer to FIGS. 2 and 3, the housing 10 includes a base 18 and a mating portion extending upwardly from the base 18. The mating portion comprises a pair of parallel long sidewalls 14 extending along a longitudinal direction of the housing 10 traversed by a pair of parallel short end walls 16 extending along a lateral direction of the housing 10 to define an elongated opening therebetween. The mating portion includes a tongue 12 located in a center of the opening, and the thickness of the tongue 12 is larger than the thickness of the sidewalls 14. The tongue 12 defines a plurality of terminal channels 124 along a top-to-bottom direction at two opposite outsides thereof, respectively. The tongue 12 further defines two rows of first passageways 122 therein. The base 18 defines a plurality of second passageways 126. The channel 124 and first passageway 122 communicate with a same second passageway 126. The housing 10 further defines an L-shaped slot 102 in each of four comers thereof, respectively.

Figure 4:
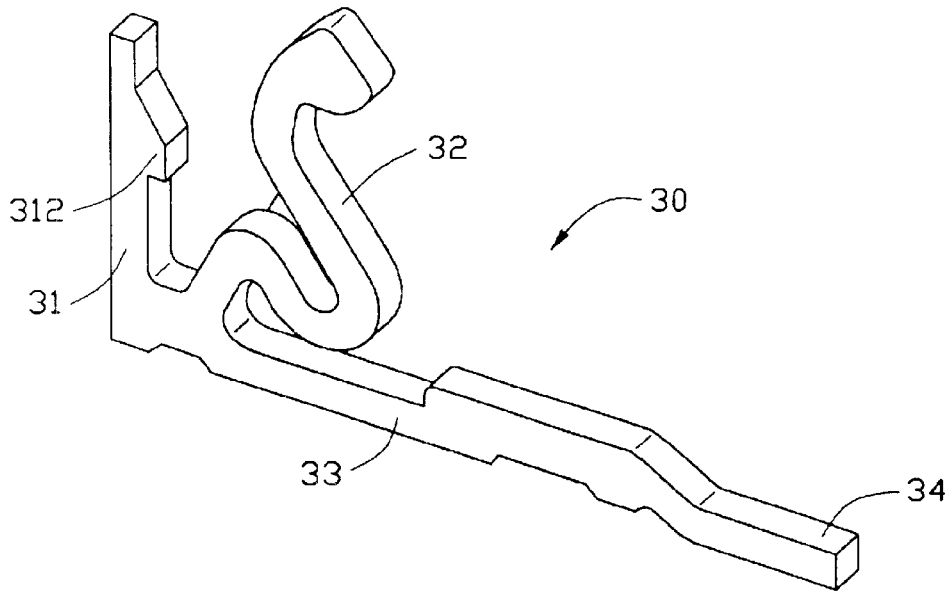
FIG. 4 is a perspective view of a terminal of the electrical connector in accordance with the present invention.

Please refer to FIG. 4, the terminals 30 arranged in two rows are received in the housing 10. Each terminal 30 includes a connecting portion 33, a retention portion 31 extending upwardly from an end of the connecting portion 33, a tail 34 extending horizontally from another end of the connecting portion 33, and a contact portion 32 extending upwardly from the connecting portion 33 adjacent to the retention portion 31. The contact portion 32 is S-shaped. The retention portion 31 further comprises a projection 312 projecting therefrom for interferentially engaging with the first passageway 124.

Please refer to FIG. 2, the pair of shields 20 are assembled onto the housing 10. Each of the shields 20 has a flat body 21 and a pair of opposite wings 22 extending laterally from opposite ends of the body 21. The shield 20 also comprises a plurality of spring tabs 23 extending upwardly from the body 21 and a plurality of grounding tabs 24 extending horizontally from the body 21.

Figure 5:
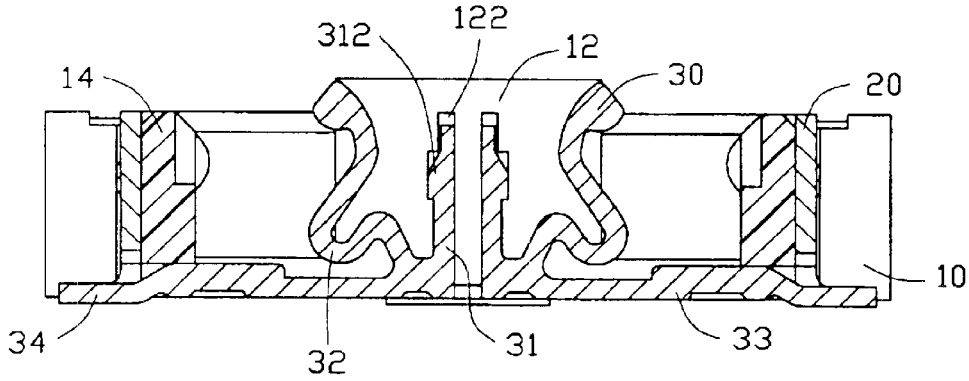
FIG. 5 is a cross-sectional view of the electrical connector taken along line 5—5 of FIG. 1.

Please refer to FIGS. 1, 2, and 5, in assembly, the terminals 30 are inserted into the housing 10 in a bottom-to-top direction. The retention portions 31 are received in corresponding first passageways 122. The contact portions 32 are received in corresponding channels 124 with part of the contact portions 31 exposing outside of the channels 124. The connecting portions 33 are received in corresponding second passageways 126. The tails 34 horizontally extend beyond the housing 10. The pair of shields 20 are received in corresponding slots 102 in a top-to-bottom direction.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector, comprising:

an elongated insulative housing comprising a pair of sidewalls, and a tongue defining a plurality of first passageways and located between the sidewalls; and a plurality of terminals received in the insulative housing and each comprising a connecting portion, a retention portion extending upwardly from the connecting portion and received in a corresponding first passageway, and a contact portion extending upwardly from the connecting portion beside the retention portion; wherein the tongue defines a plurality of channels, and the contact portions are received in corresponding channels.

2. The electrical connector of claim 1, wherein the retention portion comprises a projection projecting therefrom.

3. The electrical connector of claim 1, wherein the housing defines a plurality of second passageway receiving the connecting portion of the terminals, and the first passageway and the channels communicate with the second passageway.

4. The electrical connector of claim 1, wherein the terminal comprises a horizontally extending from the connecting portion.

5. The electrical connector of claim 1, further comprising a pair of shields assembled on the sidewalls, respectively.

6. The electrical connector of claim 5, wherein a thickness of the tongue is larger than a thickness of the sidewall.

7. An electrical connector, comprising:

an elongated insulative housing extending along a longitudinal direction and comprising a pair of sidewalls, and a tongue defining a plurality of passageways and located between the sidewalls in a lateral direction perpendicular to said longitudinal direction; and two rows of terminals received in the insulative housing in a mirror image arrangement, and each of said terminals comprising a connecting portion, a retention portion extending upwardly from the connecting portion and received in a corresponding passageway, and a contact portion extending upwardly from the connecting portion beside the retention portion and facing the corresponding sidewall; wherein the tongue defines a plurality of channels, an the contact portions are received in corresponding channels.

* * * * *